US009689240B2

(12) United States Patent
LaGrange et al.

(10) Patent No.: US 9,689,240 B2
(45) Date of Patent: Jun. 27, 2017

(54) FIRING MECHANISM WITH TIME DELAY AND METERING SYSTEM

(71) Applicant: OWEN OIL TOOLS LP, Houston, TX (US)

(72) Inventors: Timothy E. LaGrange, Rainbow, TX (US); Lyle W. Andrich, Grandview, TX (US); Bradley Vass, Fort Worth, TX (US)

(73) Assignee: OWEN OIL TOOLS LP, Houston, TX (US)

( * ) Notice: Subject to any disclaimer, the term of this patent is extended or adjusted under 35 U.S.C. 154(b) by 314 days.

(21) Appl. No.: 14/573,512

(22) Filed: Dec. 17, 2014

(65) Prior Publication Data

US 2015/0176374 A1 Jun. 25, 2015

Related U.S. Application Data

(60) Provisional application No. 61/918,435, filed on Dec. 19, 2013.

(51) Int. Cl.
*E21B 29/02* (2006.01)
*E21B 43/1185* (2006.01)

(52) U.S. Cl.
CPC ..... *E21B 43/11852* (2013.01)

(58) Field of Classification Search
CPC ..... E21B 29/02; E21B 43/116; E21B 43/117; E21B 43/1185; E21B 43/11852; E21B 43/263

(Continued)

(56) References Cited

U.S. PATENT DOCUMENTS 4,901,802 A * 2/1990 George ..... E21B 43/116 102/275
5,161,616 A * 11/1992 Colla ..... E21B 43/11852 166/297

(Continued)

FOREIGN PATENT DOCUMENTS

WO 2014027245 A2 2/2014
WO 2014027245 A3 5/2014

OTHER PUBLICATIONS

PCT/US2014/071092—PCT International Search Report dated Dec. 18, 2014.

*Primary Examiner* — Kenneth L Thompson
(74) *Attorney, Agent, or Firm* — Mossman, Kumar & Tyler PC

(57) ABSTRACT

An apparatus for selectively isolating a firing head associated with a perforating gun may include an igniter coupled to a firing head, a time delay module coupled to the igniter and generating a pressure pulse after being activated by the igniter, a metering module, and a second firing head. The metering module may be coupled to the time delay module and including a housing having a bore and at least one opening exposed to a wellbore annulus. A piston disposed in the housing bore may have at least one passage. The piston is axially displaced from a first position to a second position by the generated pressure pulse. The second firing head is coupled to the metering module and is in fluid communication with the housing bore. The piston blocks fluid communication from the at least one opening of the housing and the second firing head in a first position and allows fluid communication from the at least one opening of the housing to the second firing head in the second position.

15 Claims, 3 Drawing Sheets

(58) Field of Classification Search
USPC ..... 89/1.15; 175/4.55, 4.6; 166/297, 298, 166/55.2, 299; 102/308, 320, 325, 328, 102/329, 330
See application file for complete search history.

(56) References Cited

U.S. PATENT DOCUMENTS

| | | | | |
|---|---|---|---|---|
| 5,301,755 | A | 4/1994 | George et al. | |
| 5,890,539 | A | 4/1999 | Huber et al. | |
| 6,675,896 | B2 | 1/2004 | George | |
| 6,837,310 | B2 | 1/2005 | Martin | |
| 7,510,001 | B2 | 3/2009 | Spring et al. | |
| 7,721,650 | B2 | 5/2010 | Barton et al. | |
| 7,913,603 | B2 | 3/2011 | LaGrange et al. | |
| 8,006,779 | B2 | 8/2011 | Moore et al. | |
| 8,061,431 | B2 | 11/2011 | Moore et al. | |
| 8,079,296 | B2 | 12/2011 | Barton et al. | |
| 2007/0056724 | A1 | 3/2007 | Spring et al. | |
| 2008/0245255 | A1 | 10/2008 | Barton et al. | |
| 2010/0000789 | A1 | 1/2010 | Barton et al. | |
| 2010/0051278 | A1 | 3/2010 | Mytopher et al. | |
| 2010/0206633 | A1 | 8/2010 | Moore et al. | |
| 2010/0236781 | A1 | 9/2010 | Mytopher et al. | |
| 2015/0027302 | A1* | 1/2015 | Wall ..... | E21B 43/11852 89/1.15 |

* cited by examiner

FIRING MECHANISM WITH TIME DELAY AND METERING SYSTEM

TECHNICAL FIELD

The present disclosure relates to devices and methods for selective actuation of wellbore tools. More particularly, the present disclosure is in the field of control devices and methods for selective firing of a gun assembly.

BACKGROUND

Hydrocarbons, such as oil and gas, are produced from cased wellbores intersecting one or more hydrocarbon reservoirs in a formation. These hydrocarbons flow into the wellbore through perforations in the cased wellbore. Perforations are usually made using a perforating gun loaded with shaped charges. The gun is lowered into the wellbore on electric wireline, slickline, tubing, coiled tubing, or other conveyance device until it is adjacent to the hydrocarbon producing formation. Thereafter, a surface signal actuates a firing head associated with the perforating gun, which then detonates the shaped charges. Projectiles or jets formed by the explosion of the shaped charges penetrate the casing to thereby allow formation fluids to flow through the perforations and into a production string.

Tubing conveyed perforating (TCP) is a common method of conveying perforating guns into a wellbore. TCP includes the use of standard threaded tubulars as well as endless tubing also referred to as coiled tubing. For coiled tubing perforating systems, the perforating guns loaded with explosive shaped charges are conveyed down hole into the well connected to the end of a tubular work string made up of coiled tubing. TCP can be particularly effective for perforating multiple and separate zones of interest in a single trip. In such situations, the TCP guns are arranged to form perforations in selected zones but not perforate the gap areas separating the zones.

Some conventional system for perforating multiple zones includes perforating guns that are fired using a pressure activated firing head. Each firing head is set to actuate upon detecting a preset fluid pressure. During operation, the operator increases the pressure of the wellbore fluid in the well by activating devices such as surface pumps. The firing heads, which are exposed to the wellbore fluids, sense wellbore fluid pressure, i.e., the pressure of the fluid in the annulus formed by the gun and the wellbore wall. Once the pre-set value of the annulus fluid pressure is reached for a firing head, the firing head initiates a firing sequence for its associated gun.

In some instances, pressure variations, such as pressure spikes associated with the firing of a perforating gun, can interfere with the pressure-activated firing heads for these systems. The present disclosure addresses the need to protect pressure-activated firing heads from undesirable pressure variations as well as other drawbacks of the prior art.

SUMMARY

In aspects, the present disclosure provides an apparatus and related method for selectively isolating a firing head associated with a perforating gun. The apparatus may include a first firing head; an igniter coupled to the firing head; a time delay module coupled to the igniter, the time delay module generating a pressure pulse after being activated by the igniter; a metering module coupled to the time delay module, the metering module including a housing having a bore and at least one opening exposed to a wellbore annulus, and a piston disposed in the housing bore, the piston having at least one passage, the piston being axially displaced from a first position to a second position by the generated pressure pulse; and a second firing head coupled to the metering module, the second firing head being in fluid communication with the housing bore, the piston blocking fluid communication from the at least one opening of the housing and the second firing head in a first position and allowing fluid communication from the at least one opening of the housing to the second firing head in the second position.

In aspects, the present disclosure provides a method for selectively isolating a firing head associated with a perforating gun. The method may include forming a perforating tool by coupling an igniter to a first firing head, coupling a time delay module to the igniter, coupling a metering module to the time delay module, and coupling a second firing head to the metering module. The time delay module includes a housing having a bore and at least one opening, and a piston disposed in the housing bore and having at least one passage. The second firing head is in fluid communication with the housing bore and only in pressure communication with a wellbore annulus when the piston is in the second position.

The method further includes conveying the perforating tool into a wellbore, activating the igniter using the first firing head, activating the time delay module using a shock wave generated by the activated igniter, generating a pressure pulse using the activated time delay module, using the generated pressure pulse to axially displace the piston from a first position to a second position by the generated pressure pulse, the piston sealing the at least one opening of the housing in the first position and allowing fluid communication through the at least one opening of the housing to the bore in the second position, and increasing a pressure in a wellbore annulus after the bore of the metering module is filled with a fluid. The first firing head may be in pressure communication with the wellbore annulus while the perforating tool is being conveyed in the wellbore and the second firing head may be hydraulically isolated from the wellbore annulus while the perforating tool is being conveyed in the wellbore.

It should be understood that examples of certain features of the invention have been summarized rather broadly in order that the detailed description thereof that follows may be better understood, and in order that the contributions to the art may be appreciated. There are, of course, additional features of the invention that will be described hereinafter and which will in some cases form the subject of the claims appended thereto.

DETAILED DESCRIPTION

Figure 1:
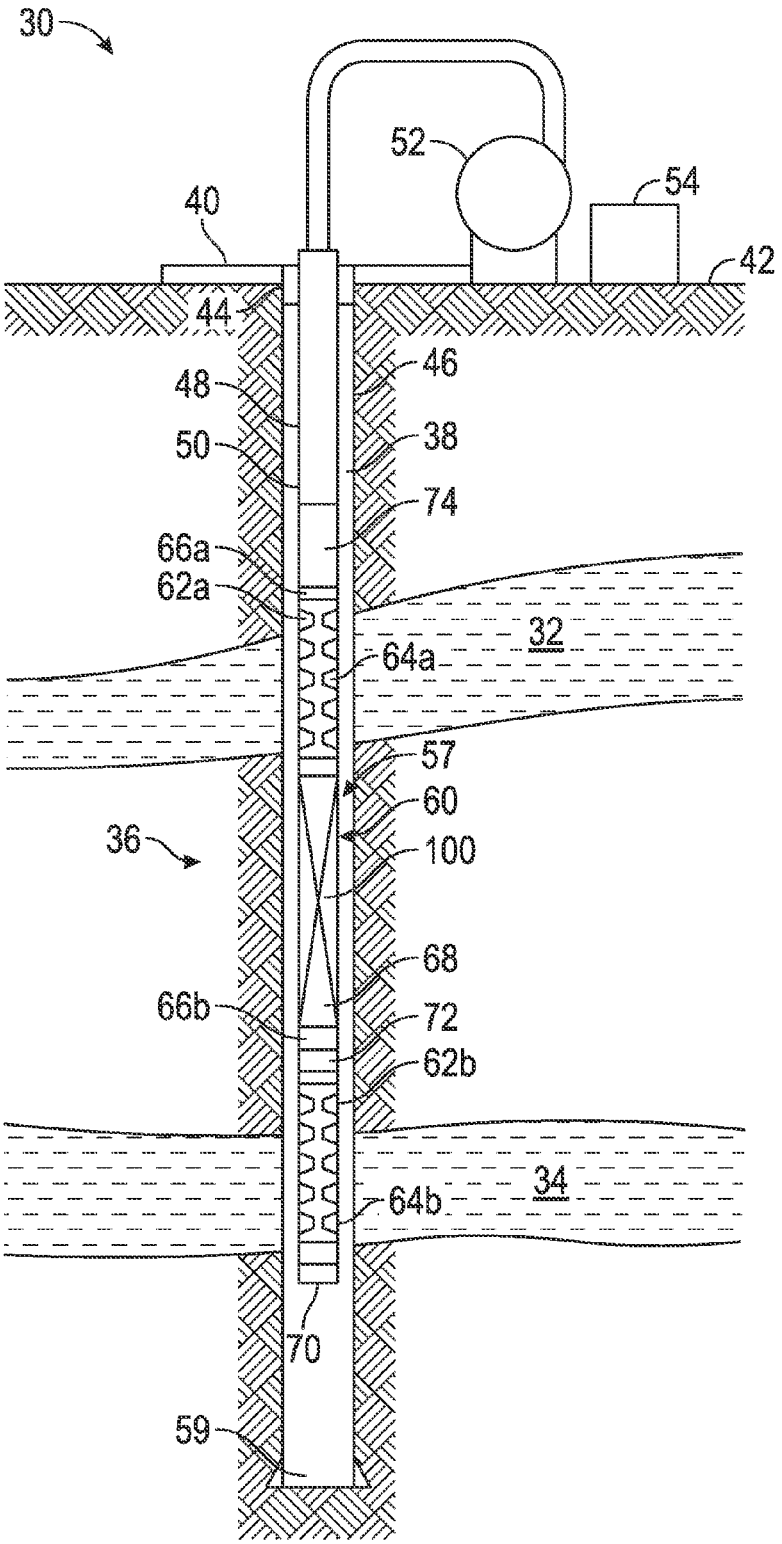
FIG. 1 schematically illustrates a deployment of a perforating gun train utilizing one embodiment of the present disclosure.

The present disclosure relates to devices and methods for firing two or more downhole tools such as perforating tools. The present disclosure is susceptible to embodiments of different forms. There are shown in the drawings, and herein will be described in detail, specific embodiments of the present disclosure with the understanding that the present disclosure is to be considered an exemplification of the principles of the invention, and is not intended to limit the invention to that illustrated and described herein.

Referring initially to FIG. 1, there is shown a well construction and/or hydrocarbon production facility 30 positioned over subterranean formations of interest 32, 34 separated by a gap section 36. The facility 30 can be a land-based or offshore rig adapted to drill, complete, or service a wellbore 38. The wellbore 38 can include a column of wellbore fluid 59 that is made up of formation fluids such as water or hydrocarbons and/or man-made fluids such as drilling fluids. The facility 30 can include known equipment and structures such as a platform 40 at the earth's surface 42, a wellhead 44, and casing 46. A work string 48 suspended within the well bore 38 is used to convey tooling into and out of the wellbore 38. The work string 48 can include coiled tubing 50 injected by a coiled tubing injector 52. Other work strings can include tubing, drill pipe, wire line, slick line, or any other known conveyance means. The work string 48 can include telemetry lines or other signal/power transmission mediums that establish one-way or two-way telemetric communication from the surface to a tool connected to an end of the work string 48. A suitable telemetry system (not shown) can be known types as mud pulse, electrical signals, acoustic, or other suitable systems. A surface control unit (e.g., a power source and/or firing panel) 54 can be used to monitor and/or operate tooling connected to the work string 48. A wellbore annulus 57 is formed between the work string 48 and the wall defining the wellbore 38. The wellbore annulus 57 is filled with the wellbore fluid 59, which can be pressurized using pumps (not shown) at the surface. While a vertical well is shown, it should be understood that devices according to the present disclosure may also be used in deviated (non-vertical) or horizontal wells.

In one embodiment, a perforating tool such as a perforating gun train 60 is coupled to an end of the work string 48. An exemplary gun train 60 includes a plurality of guns or gun sets 62*a-b*, each of which includes perforating shaped charges 64*a-b*. Merely for ease of discussion, only two gun sets 62*a-b* are shown. However, the gun train 60 may include more than two gun sets. Other equipment associated with the gun train 60 includes a bottom sub 70, a top sub 72, and an accessories package 74 that may carry equipment such as a casing collar locator, formation sampling tools, casing evaluation tools, etc.

Each gun set 62*a-b* may be fired using a firing head 66*a-b*, respectively. These firing heads 66*a-b* may be pressure actuated and configured to be activated by the same or substantially different pressure in the wellbore annulus 57. For purposes of the present disclosure, a difference of 5% may be considered a substantially different pressure. For example, the firing head 66*a* may be preset for activation at 10,000 PSI and firing head 66*b* may be preset for activation at 10,000 PSI or a different pressure, such as 11,000 PSI. An isolator 100 may be used to isolate the firing head 66*b* from annulus pressure at least until after the pressure variations associated with the firing of the perforating gun 62*a* have subsided.

Figure 2:
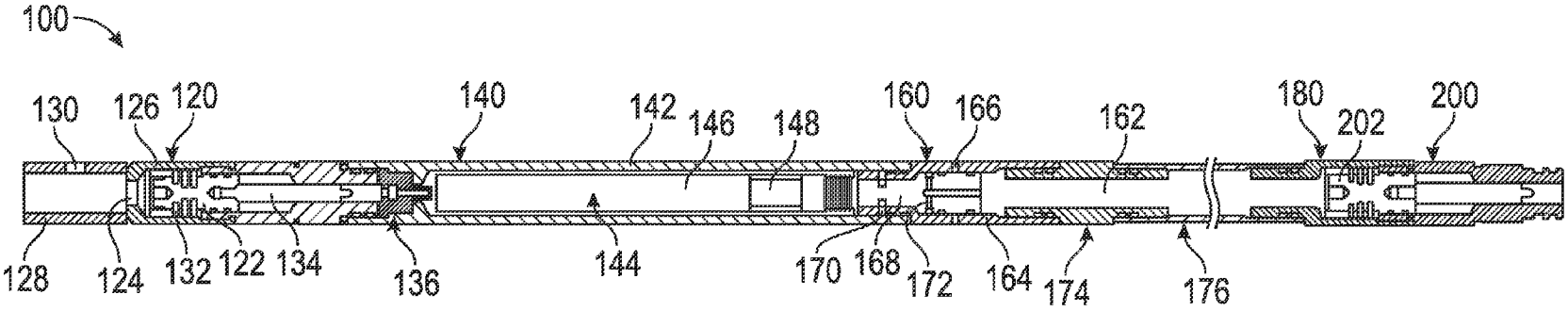
FIG. 2 schematically illustrates one embodiment of the present disclosure that selectively isolates a firing head.

Referring to FIG. 2, there is schematically illustrated one embodiment of an isolator 100. The isolator 100 may include a first firing head 120, a time delay module 140, a metering sub 160, a connector 180, and a second firing head 200. As discussed in greater detail below, the first firing head 120, the time delay module 140, and the metering sub 160 enable the upper and second guns 62*a,b* to be fired independently by pressurizing the fluid column 59 (FIG. 1) in the wellbore annulus 57 (FIG. 1).

The first firing head 120 may be a pressure-activated firing head. As used herein, a firing head is generally a device that generates an energetic output in response to a received control signal. The energetic output may be a shock wave (e.g., a high amplitude pressure wave). The control signal in this instance is a predetermined pressure in the wellbore annulus 57 (FIG. 1). Wellbore fluid acts on a piston head 122 by flowing through an opening 124 in a housing 126 of the first firing head 120. The fluid may enter the opening 124 directly or through an adjacent sub 128 that has openings 130 for receiving wellbore fluid. When sufficiently high, the fluid pressure breaks frangible elements 132 and propels a piston head 122 and associated pin 134 into an igniter 136. The frangible elements 132 may be constructed to break at a selected pressure. The igniter 136 outputs a high-order detonation that activates the time delay module 140.

The time delay module 140 adjusts or controls the time period between the time that the first gun 62*a* (FIG. 1) is fired and when the second gun 62*b* (FIG. 1) is responsive to an increase in wellbore annulus pressure. In embodiments, the time delay module 140 may include a housing 142 that is coupled to the first firing head 120 and one or more fuse(s) element 144 that generate a pressure pulse for activating the metering sub 160. When detonated, the fuse element(s) 144 burns for a predetermined time period, which may be considered a deflagration. The burn period terminates with a high-order detonation. The pressure pulse that activates the metering sub 160 may include a shock wave generated by the high-order detonation. The pressure pulse may also include this shock wave and a gas pressure generated by the deflagration. The fuse elements 144 may be pellets or capsules that include a combination of energetic materials, each of which exhibits different burn characteristics, e.g., the type or rate of energy released by that material. By appropriately configuring the chemistry, volume, and positioning of these energetic materials, the rate of gas generation may be controlled to provide the desired or predetermined time delay.

Generally, the energetic materials can include materials such as RDX, HMX that provides a high order detonation and a second energetic material that provides a deflagration. In one arrangement, the fuse elements 144 may include a deflagration component 146 and a high-order detonation component 148. Unlike the high-order detonation component 148, the deflagration component 146 does not generate a shock wave. Also, the number of fuse elements 144 may be varied to control the duration of the time delay. The fuse elements 144 may be configured to have a time delay sufficient to have pressure spikes associated with the firing of the first gun 62*a* has dissipated. In some embodiments, the time delay may be from a few seconds to one minute. In other embodiments, the time delay may be a minute to three minutes. In still other embodiments, the time delay may be three minutes or longer.

The metering sub 160 controls fluid communication between the wellbore annulus 57 (FIG. 1) and an interior bore 162. In one embodiment, the metering sub 160 may include a housing 164 that couples to the time delay module 140. The housing 164 includes openings 166 that allow fluid from the wellbore annulus 57 (FIG. 1) to flow into and fill the bore 162. A piston 168 may be used to selectively seal the openings 166. In one embodiment, the piston 168 may be formed as a cylindrical body that slides or axially translates in the bore 162. The piston 168 may be secured temporarily using frangible elements such as shear pins 170. Also, the piston 168 may include passages 172 that convey fluid between the opening 166 and the bore 162.

The bore 162 acts as a fluid reservoir that, when sufficiently pressurized, actuates the second firing head 200. The fluid reservoir may be a pressure-transmitting liquid body. The bore 162 may be formed using the interior space of the metering sub 160, a connector sub 174, and a barrel section 176. The barrel section 176 may be used to increase the volume of wellbore fluid available to activate the second firing head 200. Because the bore 162 has a fixed volume, axial displacement of a piston 202 associated with the second firing head 200 may reduce the available pressure in the bore 162. The barrel section 176 may be sized such that the change in volume associated with movement of the piston 202 does not substantially reduce the volume of the bore 162 (e.g., reduce volume by less than 10%). In some embodiments, the bore 162 may be filled with a gas, such as air, that is sealed at atmospheric pressure.

In the non-activated position, the body of the piston 168 forms a fluid tight barrier at the opening 166. The sub 160 may also include other seals (not shown) that may be used to isolate the bore 162 from the wellbore annulus 57 (FIG. 1).

Figure 3:
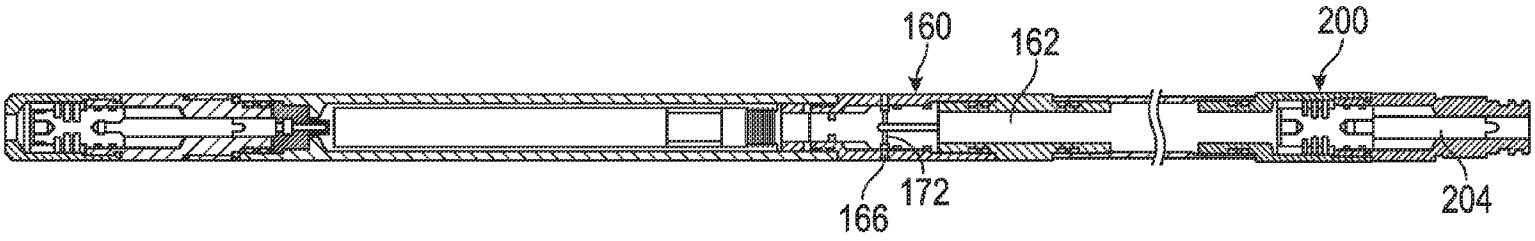
FIG. 3 schematically illustrates the FIG. 2 embodiment in a state wherein the firing head is in communication with the fluid in a well annulus.

Referring now to FIG. 3, in the activated position, the passages 172 align with the openings 166 to allow wellbore fluid to flow into the bore 162. It should be understood that the size and orientation of the openings 166 and the passage 172 control the rate at which the wellbore fluid enters and fills the bore 162. Because the bore 162 is exposed to the second firing head 200, the fluid body in the bore 162 hydraulically connects the second firing head 200 to the wellbore annulus 57 (FIG. 1).

The second firing head 200 may be a pressure-activated firing head that couples to the metering sub 160 and that generates an energetic output in response to a predetermined pressure in bore 162. When activated by the predetermined pressure, a piston 202 and associated pin 204 are propelled into an igniter (not shown). The igniter (not shown) outputs a high-order detonation that is used to fire the second perforating gun 62*b* (FIG. 1). In some embodiments, the second firing head 200 is the same configuration as the firing head 66*b* of FIG. 1.

Referring now to FIGS. 1-3, there will be described on illustrative deployment of the gun train 60 (or "perforating tool"). As discussed previously, it may be desired to sequentially fire two or more guns within a gun train. Further, it may be desired to fire each gun independently of one another. That is, each gun may be responsive to a preset firing signal. The firing signal may be a predetermined hydrostatic pressure in the wellbore annulus 57. In one arrangement, the first and the second guns 62*a,b* are configured to fire using the same or substantially same predetermined annulus pressure. For example, the firing heads 66*a,b* are configured to fire at approximately 10,000 PSI. In such an embodiment, the firing head 120 is also set to fire at approximately 10,000 PSI. After these firing heads have been appropriately set, the gun train 60 is conveyed into the wellbore 38 and positioned at a desired depth. At this time, the first firing head 66*a* may be in pressure communication with the wellbore annulus 57 whereas the second firing head 66*b* is isolated from the hydrostatic pressure of the wellbore annulus 57.

The first gun 62*a* is fired by increasing the wellbore annulus hydrostatic pressure to at least 10,000 PSI. This pressure activates the firing head 66*a*, which fires the first gun 62*a*. The second firing head 200 (which may be the firing head 66*b*) is hydraulically isolated from this annulus hydrostatic pressure. However, the annulus pressure does activate the first firing head 120. Specifically, the annulus pressure breaks the frangible elements 132 and propels the pin 134 to impact the igniter 136, which detonates the time delay module 140 using a high-order detonation (shock wave). The time delay module 140 burns for a preset amount of time (e.g., six minutes). During this time, the pressure fluctuations in the wellbore annulus 57 (FIG. 1) associated with the firing of the first gun 62*a* dissipate. The time delay may be selected such that the pressure fluctuations are low enough as to not activate the firing head 200. Also during this time, the pressure in the wellbore annulus 57 (FIG. 1) may be reduced below the activation pressure (e.g., 10,000 PSI). The burn of the time delay module 140 terminates with a high-order detonation. The detonation generates a pressure pulse that breaks the shear pins 170 and displaces the piston 168 until the passages 172 are aligned with the openings 166. In some embodiments, the shock wave alone from the time delay module 140 is sufficient to displace the piston 168. In other embodiments, the gas generated by the burning fuse elements 144 applies a pressure that assists in the displacement of the piston 168. In still other embodiments, the shock wave breaks the shear pins 170 and the gas generated by the fuses 144 is the primary force that displaces the piston 168.

Upon aligning with the openings 166, the passages 172 convey wellbore fluid from the annulus 57 into the bore 162. It should be appreciated that the sizing of the openings 166 and passages 172 controls or meters the rate at which the bore 162 is filled with the wellbore fluid. By metering the inflow of fluid, a further time delay is added in addition to preventing the second firing head 200 from encountering a sudden surge in pressure. Once the bore 162 is completely filled with wellbore fluid, the firing head 200 may be activated by increasing the pressure in the wellbore annulus 57 (FIG. 1) to a predetermined pressure (e.g., 10,000 PSI). As noted previously, the pressure increase may be performed by pressurizing the fluid column 59 using surface pumps. This pressure increase displaces the piston head 202 and propels the adjacent pin 204 into the igniter (not shown) of the second gun 62*b*. Although the displacement of the piston head 202 increases the volume of the bore 162, the barrel section 176 contains sufficient fluid to ensure that the pressure remains sufficiently high to propel the pin 204 with enough velocity to activate the igniter (not shown).

Figure 4:
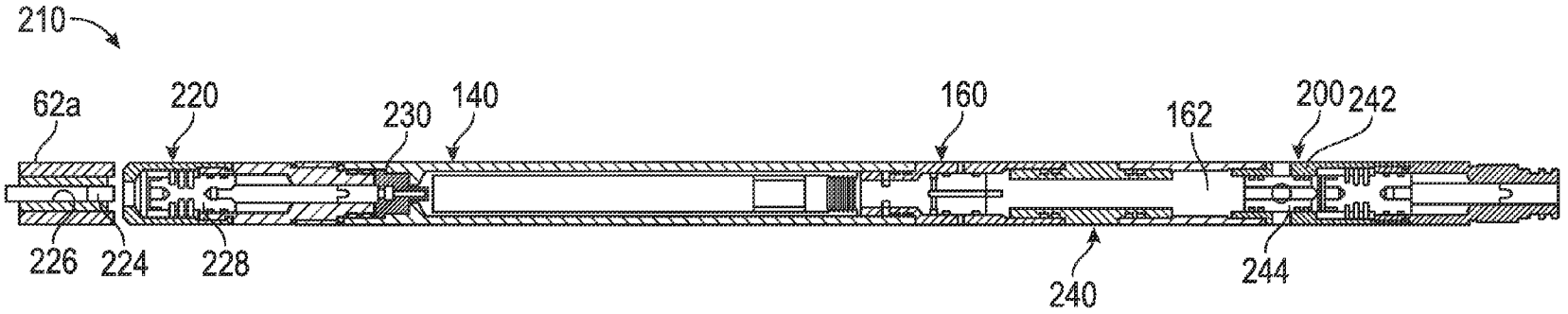
FIG. 4 schematically illustrates another embodiment of the present disclosure that selectively isolates a firing head.

Referring to FIG. 4, there is schematically illustrated another embodiment of an isolator 210. The isolator 210 may include a first firing head 220, a time delay module 140, a metering sub 160, a connector 240, and a second firing head 200, all of which are directly or indirectly connected to one another. The time delay module 140, the metering sub 160, and the second firing head 200 are generally the same as those described in connection with FIGS. 2 and 3 above. The first firing head 220 and the connector 240 are different is some respects and are discussed in greater detail below.

The first firing head 220 may be activated using a high-order detonation (e.g., using a shock wave). The high-order detonation may be generated by connecting a booster element 224 to an end of the detonator cord 226 associated with the first gun 62*a*. In a manner previously discussed, the shock wave from the detonation of the booster element 224 propels a pin 228 into an igniter 230. The igniter 230 outputs a high-order detonation that activates the time delay module 140. The time delay module 140 operates as previously described and activates the metering sub 160 using a pressure pulse. The metering sub 160 includes a bore 162 as previously described.

Figure 5:
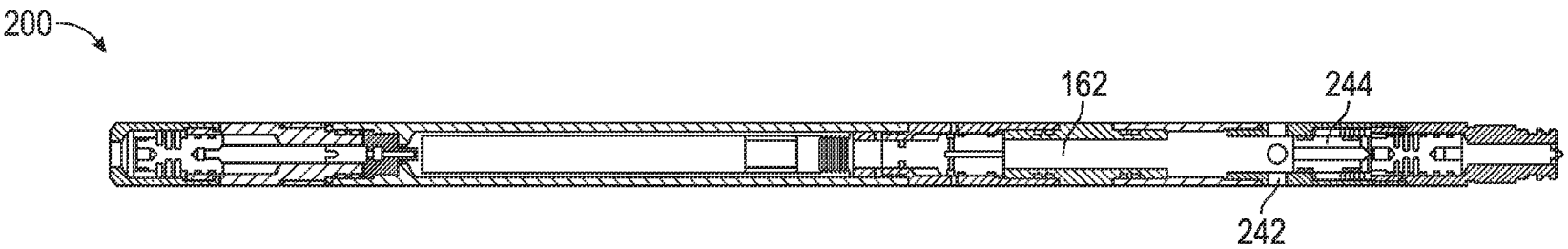
FIG. 5 schematically illustrates the FIG. 4 embodiment in a state wherein the firing head is in communication with the fluid in a well annulus.

Instead of using a barrel to accumulate fluid to assist in activating the firing head 200, the connector 240 includes a vent 242 that admits wellbore fluid into the bore 162. The vent 242 may be selectively sealed with a vent piston 244. In the non-activated position, the body of the vent piston 244 forms a fluid tight barrier at the vent 242. Referring now to FIG. 5, in the activated position, the vent piston 244 has shifted to allow the vent 242 to direct wellbore fluid to flow into the bore 162. Thus, an additional volume of fluid is available to flow into the bore 162 when the second firing head 200 is activated.

Referring now to FIGS. 1 and 4-5, there will be described on illustrative deployment of the gun train 60 that uses the isolator 210. As discussed previously, it may be desired to sequentially fire two or more guns within a gun train 60 independently of one another. In this illustrative embodiment, each gun may be responsive to a unique firing signal. The firing signal may be a predetermined pressure in the wellbore annulus 57 (FIG. 1). In one arrangement, the upper and the second guns 62*a,b* are configured to fire using a different predetermined annulus pressure. For example, the firing head 66*a* is configured to fire at approximately 10,000 PSI and the firing head 66*b* is configured to fire at approximately 12,000 PSI. After these firing heads have been appropriately set, the gun train 60 is conveyed into the wellbore 38 and positioned at a desired depth.

The first gun 62*a* is fired by increasing the wellbore annulus pressure to at least 10,000 PSI. This pressure activates the firing head 66*a*, which fires the first gun 62*a*. The second firing head 200 (which may be the firing head 66*b*) is hydraulically isolated for this pressure. The detonator cord 226 of the first firing head 66*a* detonates the booster charge 224, which activates the first firing head 220 with a shock wave. The shock wave propels the pin 228 to impact the igniter 230, which detonates the time delay module 140 using a high-order detonation (shock wave). The time delay module 140 burns for a preset amount of time (e.g., six minutes) and activates the metering sub 160 in a manner previously discussed. Once the bore 162 is completely filled, the firing head 200 may be activated by increasing the pressure in the wellbore annulus 57 (FIG. 1) to a predetermined pressure (e.g., 12,000 PSI). This pressure increase in the bore 162 displaces the vent piston 244, which allows wellbore fluid to enter through the vents 242 and thereby increases the amount of fluid available to maintain pressure in the bore 162. This fluid displaces the piston head 202 and propels the adjacent pin 204 into the igniter (not shown) of the second gun 62*b*. Because the firing of the first and second guns 62*a,b* are operationally independent, the firings can be separated by minutes, hours, or even days.

While embodiments of the present disclosure were discussed in the context of a gun train that includes only two guns, it should be understood that the teachings of the present disclosure can be readily extended to gun trains having three or more guns. Further, it should be understood that the disclosed embodiments are not mutually exclusive. For example, some embodiments may utilize an accumulator barrel and a vent. Moreover, it should be understood that some of the components may be omitted. For example, an accumulator barrel and a vent may both be eliminated in certain arrangements. Further, in some embodiments, a time delay module may not be necessary. In still other embodiments, a time delay module may be used on two or more of the guns.

The foregoing description is directed to particular embodiments of the present invention for the purpose of illustration and explanation. It will be apparent, however, to one skilled in the art that many modifications and changes to the embodiment set forth above are possible without departing from the scope of the invention. For example, while a "top down" firing arrangement has been discussed, the firing arrangement may also commence with firing the second gun first. Also, while some components are shown as directly coupled to one another, these components may also be indirectly coupled to one another. The term "couple" or "connected" refers to both direct and indirect couplings or connections. It is intended that the following claims be interpreted to embrace all such modifications and changes.

What is claimed is:

1. An apparatus for selectively isolating a firing head associated with a perforating gun, comprising:

a first firing head;

an igniter coupled to the first firing head;

a time delay module coupled to the igniter, the time delay module generating a pressure pulse after being activated by the igniter;

a metering module coupled to the time delay module, the metering module including:

a housing having a bore and at least one opening exposed to a wellbore annulus, and a piston disposed in the housing bore, the piston having at least one passage, the piston being axially displaced from a first position to a second position by the generated pressure pulse, the piston sealing the at least one opening of the housing in the first position and allowing fluid communication through the at least one opening of the housing to the bore in the second position; and a second firing head coupled to the metering module, the second firing head being in fluid communication with the housing bore and in pressure communication with the wellbore annulus when the piston is in the second position.

2. The apparatus of claim 1, wherein the time delay module has a deflagration component and a high-order detonation component, the time delay module generating the pressure pulse using at least the high-order detonation component.

3. The apparatus of claim 1, wherein the first firing head includes a first pin piston and the second firing head includes a second pin piston, and wherein the first pin piston and the second pin piston are propelled using fluid pressure.

4. The apparatus of claim 3, wherein the first pin piston is in fluid communication with a fluid in the wellbore annulus while the second pin piston is isolated from a pressure in the wellbore annulus.

5. The apparatus of claim 1, wherein the piston includes at least one frangible element connecting the piston to the housing and at least one seal forming a fluid barrier between the piston and an inner surface of the housing.

6. The apparatus of claim 1, wherein the housing bore is at substantially atmospheric pressure when the piston is in the first position.

7. The apparatus of claim 1, wherein the first firing head and the second firing head are pressure activated.

8. The apparatus of claim 7, wherein the first firing head and the second firing head are activated by substantially the same pressure.

9. The apparatus of claim 7, wherein the first firing head and the second firing head are activated by substantially different pressures.

10. The apparatus of claim 1, wherein the housing includes a barrel section, and wherein the barrel section has an internal volume selected to prevent fluid pressure in the housing bore to decrease less than ten percent when the second firing head is activated.

11. The apparatus of claim 1, wherein the housing includes a vent portion, the vent portion includes at least one vent exposed to the wellbore annulus and a vent piston, the vent piston sealing the at least one vent in a first position and unsealing the at least one vent in a second position, wherein a fluid pressure in the housing bore displaces the vent piston from the first position to the second position.

12. An apparatus for selectively isolating a firing head associated with a perforating gun, comprising:

a first pressure activated firing head;

an igniter coupled to the first firing head, the igniter generating a shock wave when detonated by the first pressure activated firing head;

a time delay module coupled to the igniter, the time delay module having a deflagration component and a high-order detonation component, the time delay module generating a pressure pulse using at least the high-order detonation component after being activated by the igniter;

a metering module coupled to the time delay module, the metering module including:

a housing having a bore, at least one opening exposed to a wellbore annulus, a piston disposed in the housing bore, the piston having at least one passage, the piston being axially displaced from a first position to a second position by the generated pressure pulse, the piston sealing the at least one opening of the housing in the first position and allowing fluid communication through the at least one opening of the housing in the second position; and a second pressure-activated firing head coupled to the metering module, the second firing head being in fluid communication with the housing bore and in pressure communication with the wellbore annulus when the piston is in the second position, the second pressure-activated firing head being activated by a pressure increase in the bore.

13. The apparatus of claim 12, wherein the first pressure-activated firing head, the time delay module, the metering module, and the second pressure-activated firing head are each formed as cylindrical bodies, wherein the first pressure-activated firing head is connected to one end of the time delay module and the metering module is connected to an opposing end of the time delay module, and second pressure activated firing head is connected to the metering module.

14. A method for selectively isolating a firing head associated with a perforating gun, comprising:

forming a perforating tool by:

coupling an igniter to a first firing head;

coupling a time delay module to the igniter;

coupling a metering module to the time delay module, the metering module including:

a housing having a bore and at least one opening, and a piston disposed in the housing bore, the piston having at least one passage and;

coupling a second firing head to the metering module, the second firing head being in fluid communication with the housing bore and only in pressure communication with a wellbore annulus when the piston is in the second position;

conveying the perforating tool into a wellbore;

activating the igniter using the first firing head;

activating the time delay module using a shock wave generated by the activated igniter;

generating a pressure pulse using the activated time delay module;

using the generated pressure pulse to axially displace the piston from a first position to a second position by the generated pressure pulse, the piston sealing the at least one opening of the housing in the first position and allowing fluid communication through the at least one opening of the housing to the bore in the second position; and increasing a pressure in a wellbore annulus after the bore of the metering module is filled with a fluid.

15. The method of claim 14, wherein the first firing head is in pressure communication with the wellbore annulus while the perforating tool is being conveyed in the wellbore and the second firing head is hydraulically isolated from the wellbore annulus while the perforating tool is being conveyed in the wellbore.

* * * * *